US009450292B2

(12) United States Patent
Irci et al.

(10) Patent No.: US 9,450,292 B2
(45) Date of Patent: Sep. 20, 2016

(54) CAVITY ANTENNAS WITH FLEXIBLE PRINTED CIRCUITS

(71) Applicant: Apple Inc., Cupertino, CA (US)

(72) Inventors: Erdinc Irci, Sunnyvale, CA (US); Jerzy Guterman, Mountain View, CA (US); Chun-Lung Chen, Sunnyvale, CA (US); Mattia Pascolini, Campbell, CA (US)

(73) Assignee: Apple Inc., Cupertino, CA (US)

( * ) Notice: Subject to any disclaimer, the term of this patent is extended or adjusted under 35 U.S.C. 154(b) by 428 days.

(21) Appl. No.: 13/910,550

(22) Filed: Jun. 5, 2013

(65) Prior Publication Data

US 2014/0361931 A1 Dec. 11, 2014

(51) Int. Cl.

| | |
|---|---|
| ***H01Q 1/42*** | (2006.01) |
| ***H01Q 1/24*** | (2006.01) |
| ***H01Q 1/38*** | (2006.01) |
| ***H01Q 9/04*** | (2006.01) |

(52) U.S. Cl.

CPC ..... *H01Q 1/243* (2013.01); *H01Q 1/38* (2013.01); *H01Q 9/0421* (2013.01)

(58) Field of Classification Search

CPC ..... H01Q 1/24; H01Q 1/48; H01Q 1/38; H01Q 1/243; H01Q 9/0421; H01Q 1/42; H01Q 9/27; H01Q 13/18

USPC ..... 343/702, 846, 789, 778, 841

See application file for complete search history.

(56) References Cited

U.S. PATENT DOCUMENTS

| | | | | |
|---|---|---|---|---|
| 2,812,514 A | | 11/1957 | Smith | |
| 2,834,959 A | | 5/1958 | Dorne | |
| 3,205,499 A | * | 9/1965 | Raburn | H01Q 13/0241 343/730 |
| 3,312,976 A | | 4/1967 | Gregory | |

(Continued)

FOREIGN PATENT DOCUMENTS

| | | |
|---|---|---|
| GB | 2074792 | 11/1981 |
| JP | 61284102 | 12/1986 |

(Continued)

OTHER PUBLICATIONS

Arnold, Shawn, "Flexible FR-4: A Low-Cost Replacement for Polyimide-based Circuits", Jun. 1, 2004, [online], retrieved Feb. 8, 2010, <http://www.circuitree.com/Articles/Feature_Article/305aa202930f7010VgnVCM100000f932a8c0_>.

(Continued)

*Primary Examiner* — Dameon E Levi
*Assistant Examiner* — Awat Salih
(74) *Attorney, Agent, or Firm* — Treyz Law Group, P.C.; G. Victor Treyz; Michael H. Lyons

(57) ABSTRACT

An antenna with a curved shape may be mounted behind a curved antenna window. The antenna may have an antenna resonating element such as an inverted-F antenna resonating element and may have an antenna ground. The antenna resonating element may be formed from patterned metal traces on a flexible printed circuit. The flexible printed circuit may have ground traces that run along a peripheral edge of the flexible printed circuit. The antenna ground may be formed from a metal can with walls surrounding a cavity having an opening. The metal can may have a lip formed from bent portions of the walls. The flexible printed circuit may be soldered to the lip so that the ground traces are shorted to the can. A cable connector may be mounted on a bent tab in the flexible printed circuit that extends through a notch in the lip.

18 Claims, 14 Drawing Sheets

(56) References Cited

U.S. PATENT DOCUMENTS 3,781,898 A * 12/1973 Holloway ..... H01Q 1/38 343/872
4,132,995 A * 1/1979 Monser ..... H01Q 13/18 343/767
4,208,660 A 6/1980 McOwen
4,245,222 A 1/1981 Eng et al.
4,710,775 A 12/1987 Coe
4,733,245 A * 3/1988 Mussler ..... H01Q 19/09 343/769
4,766,444 A * 8/1988 Conroy ..... H01Q 9/27 343/700 MS
5,061,943 A * 10/1991 Rammos ..... H01Q 1/38 343/770
5,648,786 A 7/1997 Chung et al.
5,917,454 A 6/1999 Hill et al.
6,002,311 A 12/1999 Wey et al.
6,081,729 A 6/2000 Bauerschmidt et al.
6,144,344 A * 11/2000 Kim et al. ..... 343/770
6,198,453 B1 3/2001 Chew
6,225,959 B1 5/2001 Gordon
6,339,400 B1 1/2002 Flint et al.
6,373,351 B1 4/2002 Kubota et al.
6,380,930 B1 4/2002 Van Ruymbeke
6,686,886 B2 2/2004 Flint et al.
6,853,336 B2 2/2005 Asano et al.
6,894,650 B2 5/2005 Darden et al.
6,919,853 B2 7/2005 Jordan et al.
6,950,069 B2 9/2005 Gaucher et al.
7,098,853 B2 * 8/2006 McGrath ..... H01Q 9/30 343/700 MS
7,319,431 B2 * 1/2008 Jeon ..... H01Q 1/2283 343/700 MS
7,804,453 B2 9/2010 Chiang et al.
8,102,321 B2 1/2012 Chiang et al.
8,106,836 B2 * 1/2012 Hill ..... H01Q 1/243 343/700 MS
8,125,395 B2 2/2012 Chiang
8,174,452 B2 5/2012 Vazquez et al.
8,269,677 B2 9/2012 Guterman et al.
8,319,692 B2 11/2012 Chiang et al.
8,325,094 B2 12/2012 Vazquez et al.
8,599,089 B2 12/2013 Bevelacqua et al.
8,704,714 B2 * 4/2014 Ridgeway ..... 343/700 MS
8,707,714 B2 * 4/2014 Zayer et al. ..... 62/3.2
8,773,310 B2 7/2014 Shiu et al.
8,896,487 B2 11/2014 Chiang et al.
8,963,782 B2 2/2015 Vazquez et al.
2003/0231086 A1 12/2003 Ishikawa et al.
2007/0229382 A1 * 10/2007 Rupp ..... H01Q 1/42 343/789
2009/0128263 A1 5/2009 Hesselbarth
2009/0153407 A1 6/2009 Zhang et al.
2009/0153412 A1 6/2009 Chiang et al.
2011/0012793 A1 * 1/2011 Amm et al. ..... 343/702
2011/0050508 A1 * 3/2011 Guterman et al. ..... 343/702
2011/0241943 A1 * 10/2011 Shiu ..... B23K 1/0016 343/700 MS
2011/0241948 A1 * 10/2011 Bevelacqua ..... H01Q 1/243 343/702
2012/0013521 A1 * 1/2012 Saliga ..... H01Q 9/0407 343/860
2012/0306521 A1 12/2012 Nickel
2013/0050032 A1 * 2/2013 Shiu ..... H01Q 1/24 343/702
2013/0313328 A1 * 11/2013 Mohajer-Iravani G06K 19/07749 235/492

FOREIGN PATENT DOCUMENTS

WO 2010/013982 2/2010
WO 2010085706 7/2010

OTHER PUBLICATIONS

Kotani et al.: "A rectangular cavity 1 backed slot antenna with parasitic slots", IEEE Antennas and Propagation Society International Symposium. 2001 Digest. APS. Boston, MA, Jul. 8-13, 2001; vol. 3, Jul. 8, 2001, pp. 166-169.

* cited by examiner

CAVITY ANTENNAS WITH FLEXIBLE PRINTED CIRCUITS

BACKGROUND

This relates generally to electronic devices, and, more particularly, to antennas in electronic devices.

Electronic devices such as portable computers and handheld electronic devices are often provided with wireless communications capabilities. For example, electronic devices may have wireless communications circuitry to communicate using cellular telephone bands and to support communications with satellite navigation systems and wireless local area networks.

It can be difficult to incorporate antennas and other electrical components successfully into an electronic device. Some electronic devices are manufactured with small form factors, so space for components is limited. In many electronic devices, the presence of conductive structures can influence the performance of electronic components, further restricting potential mounting arrangements for components such as antennas.

It would therefore be desirable to be able to provide improved electronic device antennas.

SUMMARY

An electronic device may be provided with a housing. An antenna window may be formed in the housing. The housing and the antenna window may have matching curved shapes.

An antenna with a curved shape that matches the curved shape of the antenna window may be mounted behind the antenna window. The antenna may have an antenna resonating element such as an inverted-F antenna resonating element and may have an antenna ground. The antenna resonating element may be formed from patterned metal traces on a flexible printed circuit. The antenna ground may be formed from a metal can that defines a cavity with an opening.

The flexible printed circuit may have ground traces that run along a peripheral edge of the flexible printed circuit. The metal can may have walls that surround a cavity with an opening. The metal can may have a lip formed from bent portions of the walls. The flexible printed circuit may cover the opening.

The flexible printed circuit may be bowed outwards away from the cavity so that the flexible printed circuit has a curved surface that matches the curved shape of the antenna window.

The flexible printed circuit may be soldered to the lip so that the ground traces are shorted to the can. A cable connector may be mounted on a bent tab in the flexible printed circuit. The lip may have a notch. The bent tab may pass through the notch. Solder may be used to attach the bent tab to one of the walls of the metal can. A cable connector may be soldered to the tab.

Further features of the invention, its nature and various advantages will be more apparent from the accompanying drawings and the following detailed description of the preferred embodiments.

DETAILED DESCRIPTION

Electronic devices may include antennas. The antennas may be used to support wireless communications such as cellular telephone communications, wireless local area network communications, peer-to-peer communications, satellite navigation system communications, and other wireless communications. Illustrative electronic devices that may be provided with antennas are shown in FIGS. 1, 2, 3, 4, and 5.

Figure 1:
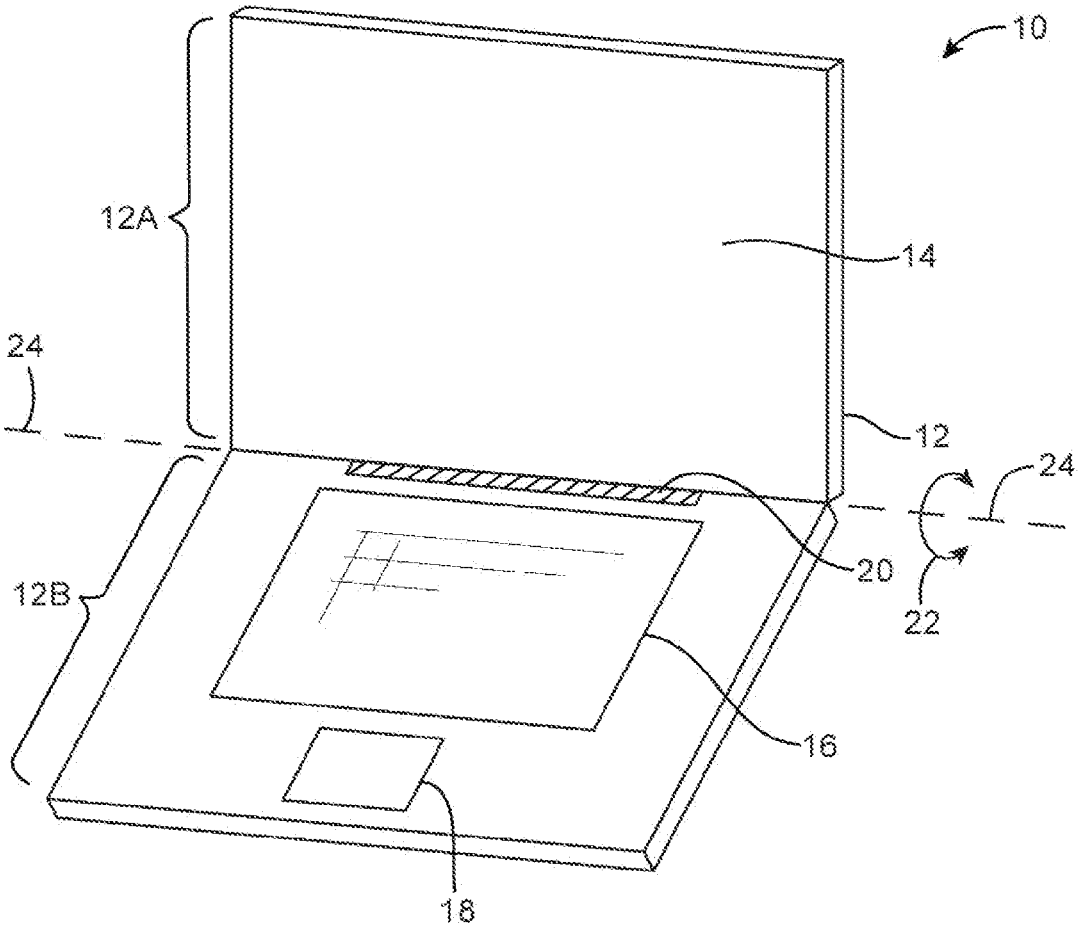
FIG. 1 is a perspective view of an illustrative electronic device such as a laptop computer of the type that may be provided with antenna structures in accordance with an embodiment of the present invention.

FIG. 1 shows how electronic device 10 may have the shape of a laptop computer having upper housing 12A and lower housing 12B with components such as keyboard 16 and touchpad 18. Device 10 may have hinge structures 20 that allow upper housing 12A to rotate in directions 22 about rotational axis 24 relative to lower housing 12B. Display 14 may be mounted in upper housing 12A. Upper housing 12A, which may sometimes referred to as a display housing or lid, may be placed in a closed position by rotating upper housing 12A towards lower housing 12B about rotational axis 24.

Figure 2:
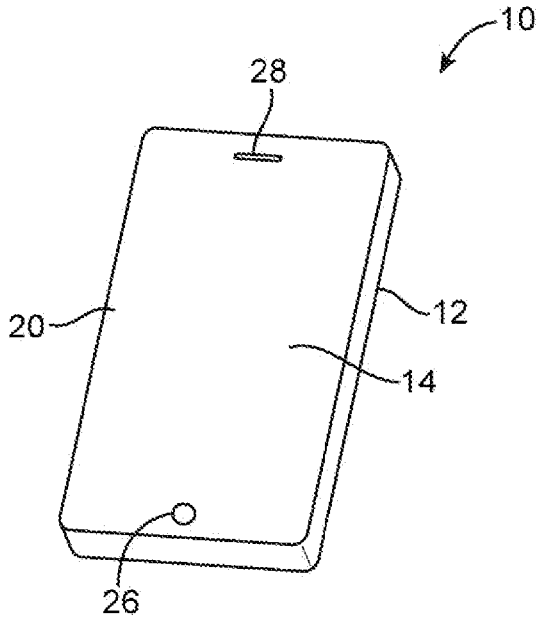
FIG. 2 is a perspective view of an illustrative electronic device such as a handheld electronic device of the type that may be provided with antenna structures in accordance with an embodiment of the present invention.

FIG. 2 shows how electronic device 10 may be a handheld device such as a cellular telephone, music player, gaming device, navigation unit, or other compact device. In this type of configuration for device 10, housing 12 may have opposing front and rear surfaces. Display 14 may be mounted on a front face of housing 12. Display 14 may, if desired, have openings for components such as button 26. Openings may also be formed in display 14 to accommodate a speaker port (see, e.g., speaker port 28 of FIG. 2).

Figure 3:
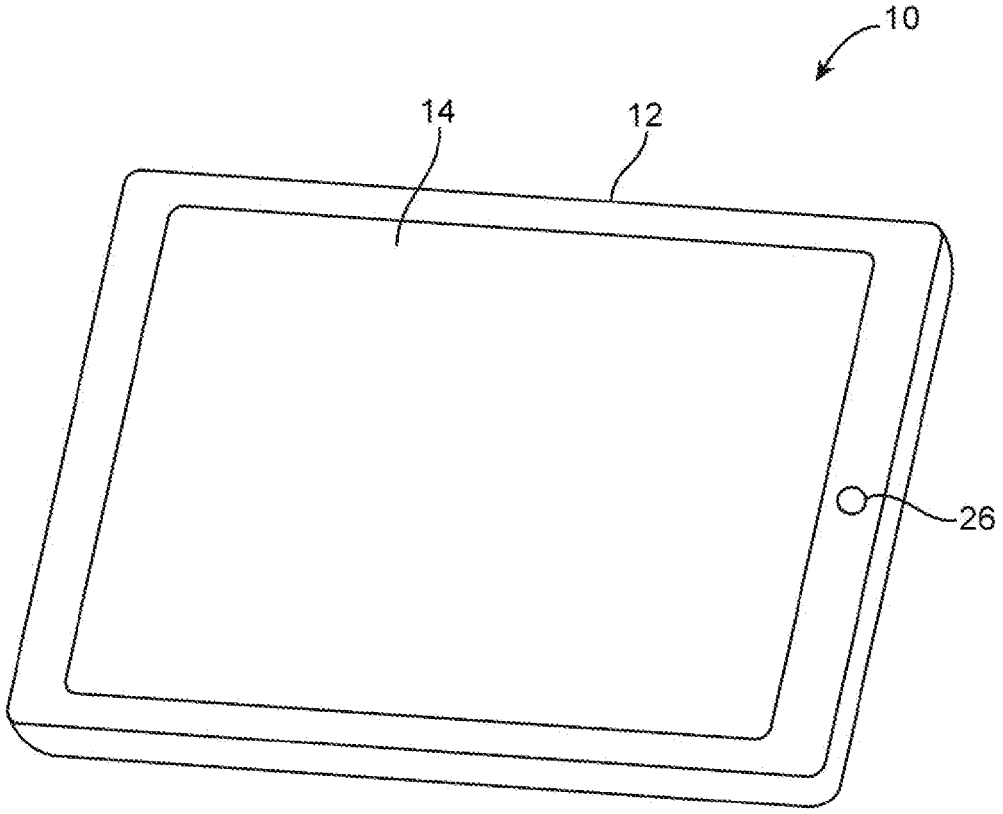
FIG. 3 is a perspective view of an illustrative electronic device such as a tablet computer of the type that may be provided with antenna structures in accordance with an embodiment of the present invention.

FIG. 3 shows how electronic device 10 may be a tablet computer. In electronic device 10 of FIG. 3, housing 12 may have opposing planar front and rear surfaces. Display 14 may be mounted on the front surface of housing 12. As shown in FIG. 3, display 14 may have an opening to accommodate button 26 (as an example).

Figure 4:
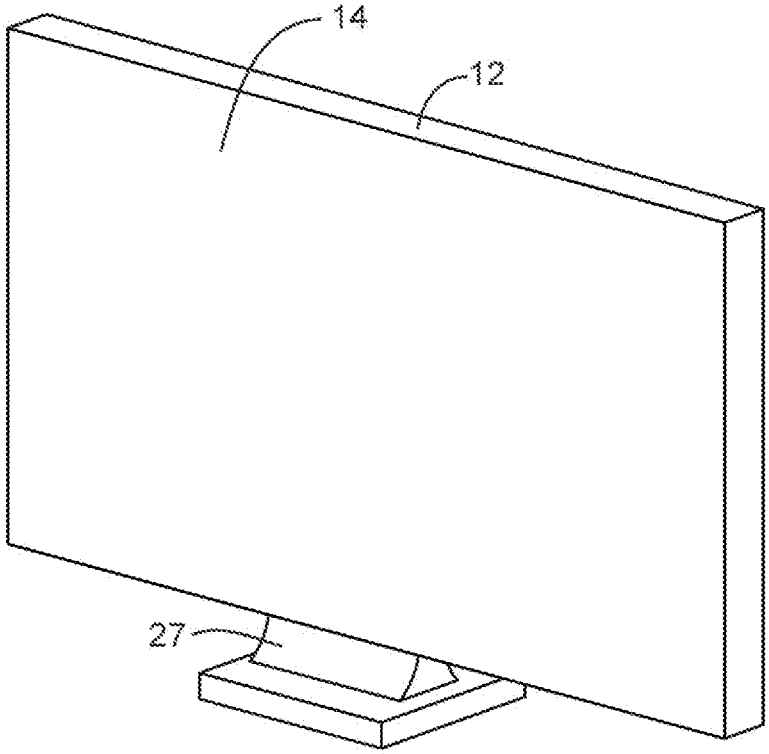
FIG. 4 is a perspective view of an illustrative electronic device such as a computer display of the type that may be provided with antenna structures in accordance with an embodiment of the present invention.

FIG. 4 shows how electronic device 10 may be a computer display or a computer that has been integrated into a computer display. With this type of arrangement, housing 12 for device 10 may be mounted on a support structure such as stand 27. Display 14 may be mounted on a front face of housing 12.

Figure 5:
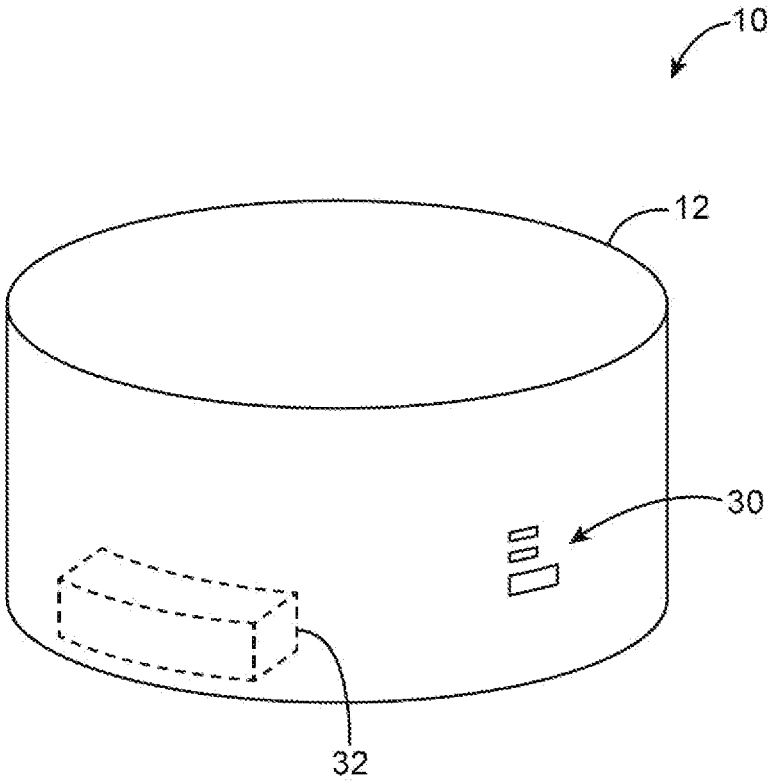
FIG. 5 is a perspective view of an electronic device such as a computer, set-top box, or wireless router that may be provided with antenna structures in accordance with an embodiment of the present invention.

FIG. 5 shows how electronic device 10 may be a computer, a wireless router, a set-top box, or other electrical equipment. Housing 12 may have a cylindrical shape with curved sidewalls and planar upper and lower surfaces, may have a rectangular box shape (e.g., a box shape with rounded corners), and/or may have other shapes with curved and/or planar housing walls.

Sensors, input-output devices, buttons, and other components such as connectors 30 may be mounted in housing 12. Connectors 30 may include audio jacks or other audio connectors, Universal Serial Bus connectors, Ethernet connectors, and other digital data port connectors, removable media connectors, and other connectors.

Antenna structures 32 (e.g., one or more antennas) may be mounted within the interior of device 10 (e.g., in the interior of housing 12). If desired, antenna 32 may have an antenna cavity. A conductive antenna ground structure with walls may surround and define a dielectric volume (sometimes referred to as an antenna cavity). The conductive structures that define the antenna cavity may be formed from a metal can or other conductive structures.

Antennas such as antenna 32 of FIG. 5 that include a metal can for forming an antenna cavity may sometimes be referred to as cavity antennas. Cavity antenna 32 may face outwards from the interior of device 10. In configurations of the type shown in FIG. 5 in which housing 12 has one or more curved surfaces, antenna 32 may have a corresponding curved portion that is mounted against the curved housing surface. This helps minimize the amount of space that is consumed by the antenna within the interior of device 10 while enhancing antenna efficiency by locating the antenna in a prominent position.

Electronic devices such as electronic devices 10 of FIG. 5 and electronic devices 10 of FIGS. 1, 2, 3, and 4 may each be provided with one or more antennas such as antenna 32. The configuration of FIG. 5 is merely illustrative.

The configurations for device 10 that are shown in FIGS. 1, 2, 3, 4, and 5 are provided as examples. In general, electronic device 10 may be a laptop computer, a computer monitor containing an embedded computer, a tablet computer, a cellular telephone, a media player, or other handheld or portable electronic device, a smaller device such as a wrist device, a pendant device, a headphone or earpiece device, or other wearable or miniature device, a television, a computer display that does not contain an embedded computer, a gaming device, a navigation device, an embedded system such as a system in which electronic equipment is mounted in a kiosk or automobile, equipment that implements the functionality of two or more of these devices, or other wireless electronic equipment.

Housing 12 of device 10, which is sometimes referred to as a case, may be formed of materials such as plastic, glass, ceramics, carbon-fiber composites and other fiber-based composites, metal (e.g., machined aluminum, stainless steel, or other metals), other materials, or a combination of these materials. Device 10 may be formed using a unibody construction in which most or all of housing 12 is formed from a single structural element (e.g., a piece of machined metal or a piece of molded plastic) or may be formed from multiple housing structures (e.g., outer housing structures that have been mounted to internal frame elements or other internal housing structures).

Display 14 may be a touch sensitive display that includes a touch sensor or may be insensitive to touch. Touch sensors for display 14 may be formed from an array of capacitive touch sensor electrodes, a resistive touch array, touch sensor structures based on acoustic touch, optical touch, or force-based touch technologies, or other suitable touch sensor components. Display 14 for device 10 may include display pixels formed from liquid crystal display (LCD) components, organic light-emitting diode components, or other suitable image pixel structures.

Figure 6:
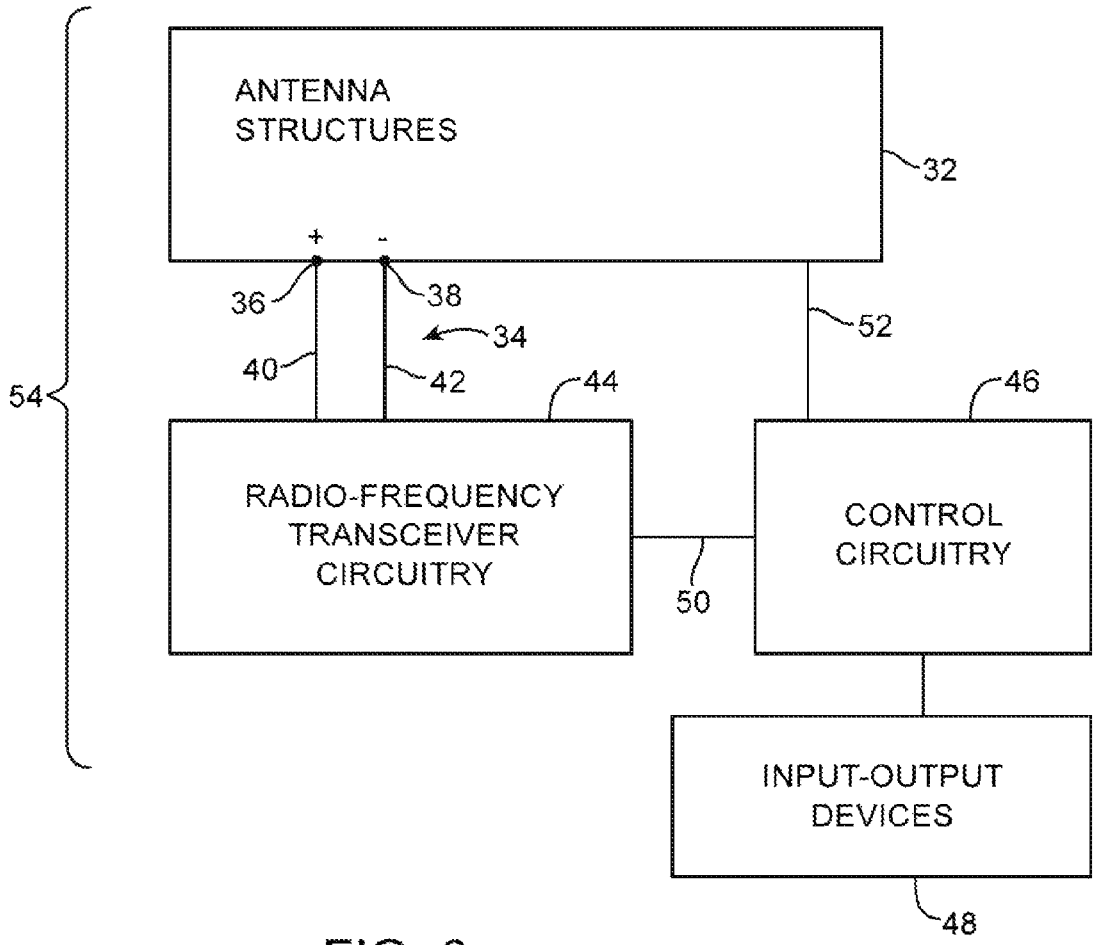
FIG. 6 is a diagram of antenna structures and associated circuitry in an electronic device in accordance with an embodiment of the present invention.

A schematic diagram of an illustrative configuration that may be used for electronic device 10 is shown in FIG. 6. As shown in FIG. 6, electronic device 10 may include control circuitry 46, input-output devices 48, and wireless circuitry 54.

Control circuitry 46 may include storage and processing circuitry for controlling the operation of device 10. Control circuitry 46 may, for example, include storage such as hard disk drive storage, nonvolatile memory (e.g., flash memory or other electrically-programmable-read-only memory configured to form a solid state drive), volatile memory (e.g., static or dynamic random-access-memory), etc. Control circuitry 46 may include processing circuitry based on one or more microprocessors, microcontrollers, digital signal processors, baseband processors, power management units, audio codec chips, application specific integrated circuits, etc.

Control circuitry 46 may be used to run software on device 10, such as operating system software and application software. Using this software, control circuitry 46 may, for example, transmit and receive wireless data, tune antennas to cover communications bands of interest, and perform other functions related to the operation of device 10.

Input-output devices 48 may be used to allow data to be supplied to device 10 and to allow data to be provided from device 10 to external devices. Input-output circuitry in devices 48 may include communications circuitry such as wired communications circuitry.

Input-output devices 48 may include input-output components with which a user can control the operation of device 10. A user may, for example, supply commands through input-output devices 48 and may receive status information and other output from device 10 using the output resources of input-output devices 48.

Input-output devices 48 may include sensors and status indicators such as an ambient light sensor, a proximity sensor, a temperature sensor, a pressure sensor, a magnetic sensor, an accelerometer, and light-emitting diodes and other components for gathering information about the environment in which device 10 is operating and providing information to a user of device 10 about the status of device 10. Audio components in devices 48 may include speakers and tone generators for presenting sound to a user of device 10 and microphones for gathering user audio input. Devices 48 may include one or more displays such as display 14. Displays may be used to present images for a user such as text, video, and still images. Sensors in devices 48 may include a touch sensor array that is formed as one of the layers in display 14. During operation, user input may be gathered using buttons and other input-output components in devices 48 such as touch pad sensors, buttons, joysticks, click wheels, scrolling wheels, touch sensors such as a touch sensor array in a touch screen display or a touch pad, key pads, keyboards, vibrators, cameras, and other input-output components.

Device 10 may use wireless circuitry 54 to communicate over one or more wireless communications bands. Wireless communications circuitry 54 may include radio-frequency (RF) transceiver circuitry such as transceiver circuitry 44 that is formed from one or more integrated circuits, power amplifier circuitry, low-noise input amplifiers, passive RF components, one or more antennas such as antenna structures 32, and other circuitry for handling RF wireless signals. Transceiver circuitry 44 may communicate with control circuitry 46 via path 50. Transceiver circuitry 44 may be used for handling cellular telephone communications, wireless local area network signals, and satellite navigation system signals such as signals at 1575 MHz from satellites associated with the Global Positioning System. Transceiver circuitry 44 may handle 2.4 GHz and 5 GHz bands for WiFi® (IEEE 802.11) communications or other wireless local area network communications and may handle the 2.4 GHz Bluetooth® communications band. Circuitry 44 may include cellular telephone transceiver circuitry for handling wireless communications in cellular telephone bands such as the bands in the range of 700 MHz to 2.7 GHz (as examples).

Wireless communications circuitry 54 can include circuitry for other short-range and long-range wireless links if desired. For example, wireless communications circuitry 54 may include wireless circuitry for receiving radio and television signals, paging circuits, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles. Wireless communications circuitry 54 may also include circuitry for handing near field communications.

Wireless communications circuitry 54 may include antenna structures 32. Antenna structures 32 may include one or more antennas. Antenna structures 32 may include inverted-F antennas, slot antennas, patch antennas, loop antennas, monopoles, dipoles, single-band antennas, dual-band antennas, antennas that cover more than two bands, cavity antennas, or other suitable antennas.

To provide antenna structures 32 with the ability to cover communications frequencies of interest, antenna structures 32 may be provided with impedance matching circuitry, filter circuitry, and/or adjustable antenna circuitry. These circuits may be adjusted using control signals from control circuitry 46 that are provided to the circuits over one or more paths such as path 52.

Transceiver circuitry 44 may be coupled to antenna structures 32 by signal paths such as signal path 34. Signal path 34 may include one or more transmission lines. As an example, signal path 34 of FIG. 6 may be a transmission line having a positive signal conductor such as line 40 and a ground signal conductor such as line 42. Lines 40 and 42 may form parts of a coaxial cable, a stripline transmission line, or a microstrip transmission line (as examples). A matching network formed from components such as inductors, resistors, and capacitors may be used in matching the impedance of antenna structures 32 to the impedance of transmission line 34. Matching network components may be provided as discrete components (e.g., surface mount technology components) or may be formed from housing structures, printed circuit board structures, traces on plastic supports, etc. Components such as these may also be used in forming filter circuitry in antenna structures 32 and/or tunable circuitry in antenna structures 32.

Transmission line 34 may be coupled to antenna feed structures associated with antenna structures 32. As an example, antenna structures 32 may form an inverted-F antenna having an antenna feed with a positive antenna feed terminal such as terminal 36 and a ground antenna feed terminal such as ground antenna feed terminal 38. Positive transmission line conductor 40 may be coupled to positive antenna feed terminal 36 and ground transmission line conductor 42 may be coupled to ground antenna feed terminal 38. Other types of antenna feed arrangements may be used if desired. The illustrative feeding configuration of FIG. 6 is merely illustrative.

Figure 7:
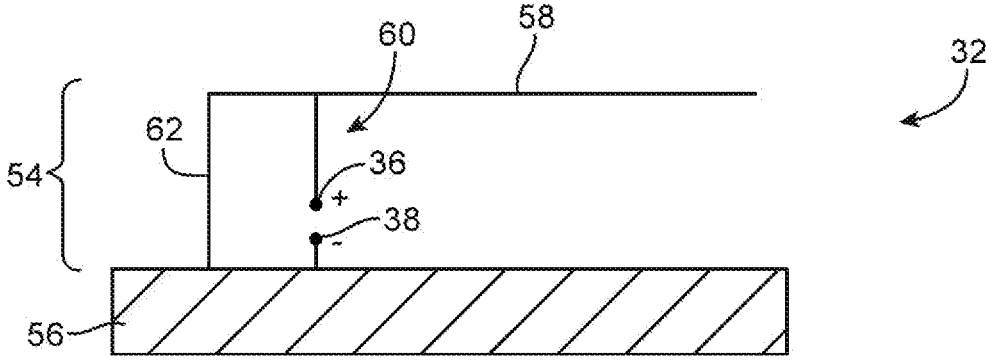
FIG. 7 is a diagram of antenna structures based on an inverted-F antenna design of the type that may be used in an electronic device in accordance with an embodiment of the present invention.

FIG. 7 is a diagram of an illustrative inverted-F antenna of the type that may be used in forming antenna 32 of FIG. 6. If desired, other types of antenna may be used in forming antenna 32. The use of an inverted-F antenna design for antenna 32 is merely an example.

As shown in FIG. 7, antenna 32 may include inverted-F antenna resonating element 54 and antenna ground 56. Antenna resonating element 54 may include one or more arms such as arm 58. Return path 62 may couple main resonating element arm 58 to antenna ground 56. Feed 60 may be coupled in parallel with return path 62 between arm 58 and ground 56.

Metal traces on a flexible printed circuit or other substrate may be used in implementing structures such as resonating element 54. Antenna ground 56 may be formed using metal traces on a flexible printed circuit or other substrate, using portions of housing 12 or other housing structures, using portions of internal device components, and using other conductive structures in device 10. As an example, antenna ground 56 may be formed from a metal can or other structure that forms a cavity for antenna 32. The can may be hollow and filled with a dielectric such as air and/or plastic. The metal can may have walls that define a cavity with an opening that faces the exterior of housing 12. Antenna resonating element 54 may be formed from patterned metal traces on a flexible printed circuit that is mounted in the metal can over the opening. The walls of the metal can may help to isolate the antenna from internal components in device 10, so that antenna performance is not sensitive to the presence and position of internal device components.

Housing 12 may be formed from plastic or other dielectric that is transparent to radio-frequency signals. If desired, housing 12 may be formed from conductive materials such as metal. In this type of configuration, a plastic insert or other structure formed from dielectric may be mounted within an opening in the metal housing to form an antenna window (i.e., a window in the housing that is transparent to radio-frequency antenna signals).

Figure 8:
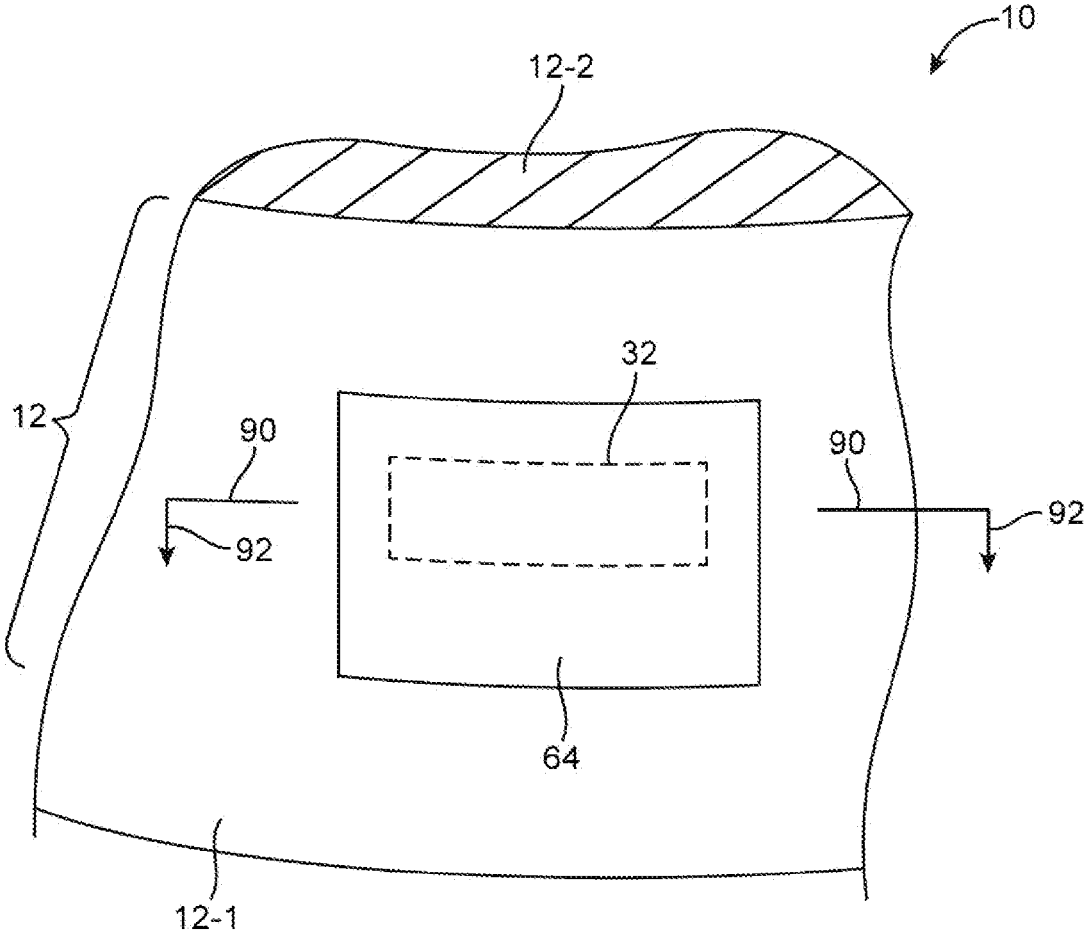
FIG. 8 is a perspective view of a portion of a curved housing wall with a curved antenna window in an electronic device in accordance with an embodiment of the present invention.

FIG. 8 is a perspective view of a portion of an illustrative housing 12 for electronic device 10. In the example of FIG. 8, device 10 has a cylindrical shape such as the cylindrical shape of device 10 of FIG. 5. As shown in FIG. 8, housing 12 has a curved sidewall portion such as housing sidewall 12-1 and a planar top portion such as planar upper housing wall 12-2. Housing structures 12-1 and 12-2 may be formed from metal or other conductive material (as an example). Antenna window 64 may be formed from a dielectric material such as plastic. As shown in FIG. 8, antenna window 64 may have a curved shape that matches the curved shape of curved housing wall 12-1. Antenna 32 may be mounted behind window 64. To accommodate the curved surface shape of window 64, antenna 32 may have a mating curved surface. The curved surface of antenna 32 may be formed by bending an antenna substrate such as a flexible printed circuit containing antenna traces. The flexible printed circuit may, for example, be bowed outward so that the flexible printed circuit has a curved surface that matches the curved inner surface of antenna window 64. Cavity structures such as a metal can may have corresponding curved portions.

Figure 9:
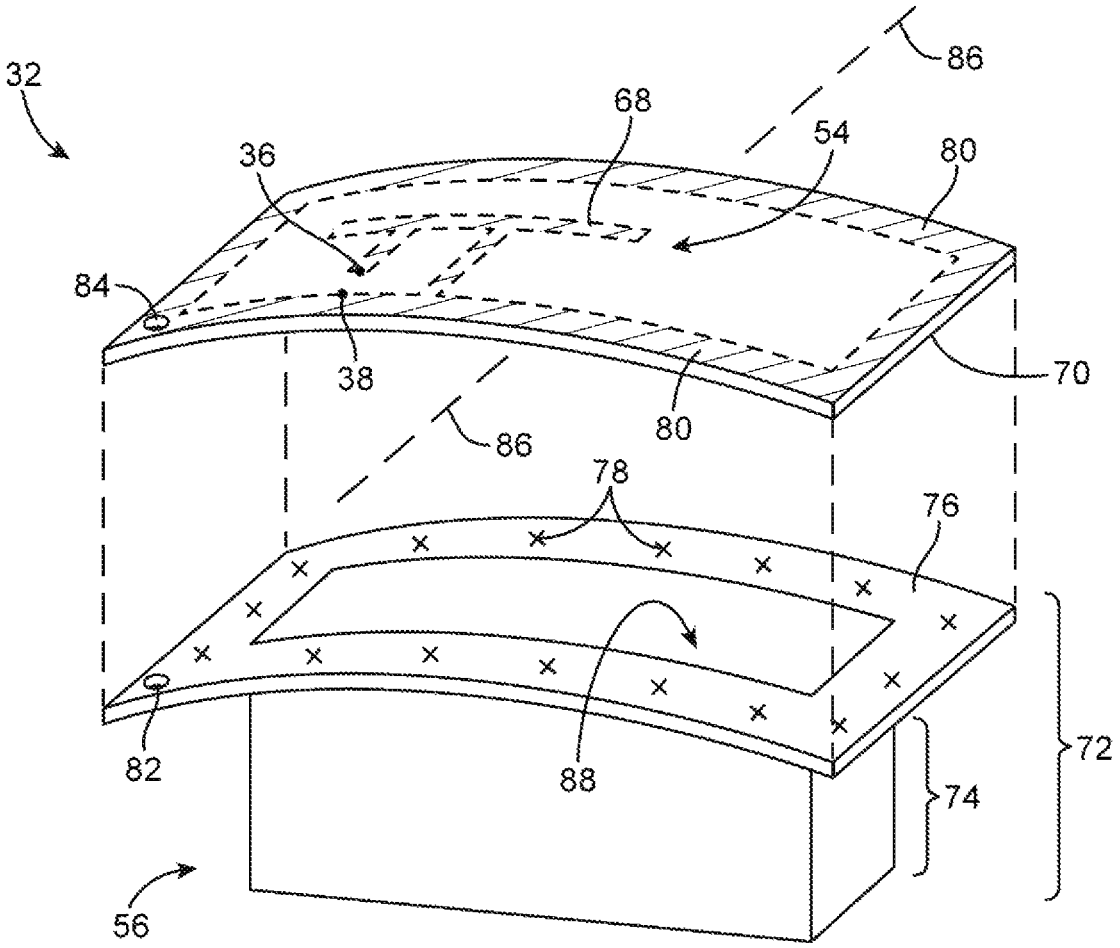
FIG. 9 is a perspective view of an illustrative cavity antenna of the type that may be mounted behind an antenna window such as the antenna window of FIG. 8 in accordance with an embodiment of the present invention.

FIG. 9 is an exploded perspective view of antenna 32 in a configuration in which antenna 32 has been configured to mate with a curved structure such as a curved dielectric housing or a curved dielectric window member in a housing. As shown in FIG. 9, antenna 32 may include antenna resonating element 54 and antenna ground 56. Antenna resonating element 54 may be formed from patterned metal traces 68 on flexible printed circuit 70. Flexible printed circuit 70 may contain one or more layers of metal traces and one or more layers of flexible dielectric material. Vias may couple together metal traces in different layers of flexible printed circuit 70. With one illustrative arrangement, flexible printed circuit 70 may be formed from a sheet of flexible polymer such as a layer of polyimide and metal traces 68 may be formed from metals such as copper, aluminum, gold, metal alloys, or other metals.

Openings such as hole 84 may be formed in flexible printed circuit 70. There may be, for example, a hole at each of the four corners of flexible printed circuit 70 (e.g., in a configuration of the type shown in FIG. 9 in which flexible printed circuit 70 has a rectangular outline). Flexible printed circuit 70 may be bent around bend axis 86 (i.e., flexible printed circuit 70 may be bowed outwards to form a convex shape). With this type of arrangement, the exposed upper surface of flexible printed circuit 70 has a curved shape that mates with a curved inner surface of antenna window 64 (FIG. 8).

Antenna ground 56 may be formed from metal can 72. Can 72 may be a stamped sheet metal structure or may be formed using other techniques (e.g., welding, soldering, machining, stamping, die-cutting, molding, etc.). As shown in FIG. 9, can 72 may have sidewalls 74 and lip 76. Sidewalls 74 may form a cavity with an opening such as cavity 88. Lip 76 may surround the opening of cavity 88 and may be formed from portions of sidewalls 74 that are bent outwards from the opening (e.g., portions oriented at a right angle with respect to sidewalls 74). Lip 76 may have a flat upper surface that mates with ground traces 80 that lie along the periphery of rectangular flexible printed circuit 70. Ground traces 80 may have the shape of a rectangular ring (e.g., in configurations in which flexible printed circuit 70 has a rectangular outline).

Conductive material 78 (e.g., solder, conductive adhesive, metal in a welded structure, etc.) may be used to electrically and mechanically couple lip 76 of antenna can 72 to ring-shaped ground traces 80 on flexible printed circuit 70. Ground traces 80 may surround the periphery of flexible printed circuit 70 (i.e., ground traces 80 may run along the peripheral edge of flexible printed circuit 70) and may therefore sometimes be referred to as peripheral ground traces. Ground traces 80 may be formed on the lower surface of printed circuit 70 (and, if desired, other layers of flexible printed circuit 70) to short antenna ground traces 80 to lip 76 and other portions of can 72 in antenna ground 56. Lip 76 may have openings such as opening 82 that mate with respective openings 84 in flexible printed circuit 70. Screws may pass through openings 82 and 84 (e.g., to screw antenna 32 to an antenna window and/or metal housing 12).

Lip 76 may have a curved shape that mates with the curved shape of bent flexible printed circuit 70. This allows can 72 and flexible printed circuit 70 to be mounted flush with the curved interior surface of antenna window 64 or other curved structures in device 10. If desired, lip 76 and flexible printed circuit 70 may have other shapes (e.g., undulating shapes with multiple bends, planar shapes with no bends, convex shapes, concave shapes, etc.).

Figure 10:
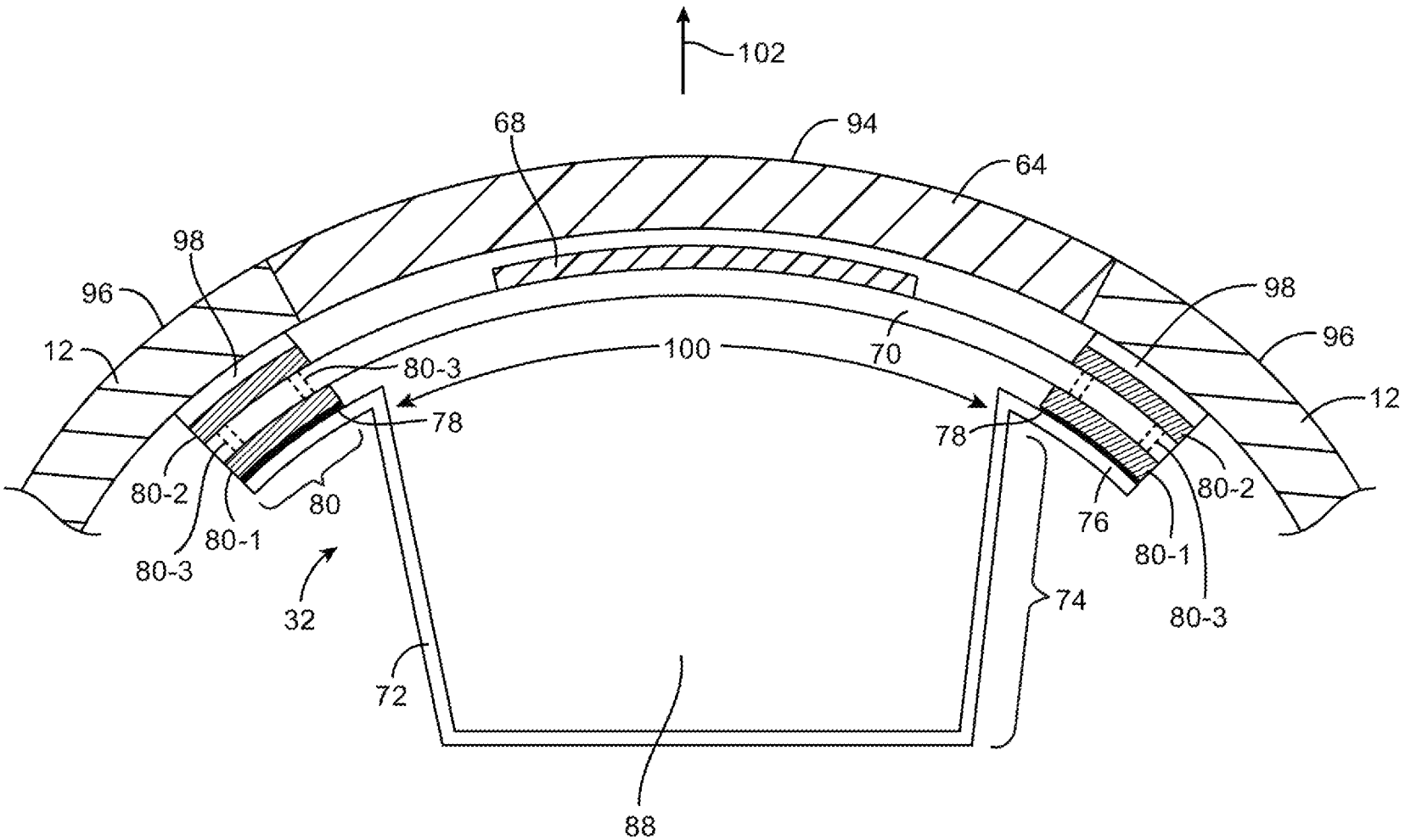
FIG. 10 is a cross-sectional side view of an illustrative cavity antenna mounted under a curved antenna window in an electronic device with a curved housing wall in accordance with an embodiment of the present invention.

FIG. 10 is a cross-sectional view of antenna 32 in electronic device 10 taken along line 90 of FIG. 8 and viewed in direction 92. As shown in FIG. 10, antenna window 64 may have a curved shape with a curved outer surface 94 that matches curved outer surface 96 of housing 12. Housing 12 and antenna window 64 may, if desired, have opposing curved inner surfaces that run parallel to their outer surfaces.

Antenna resonating element 54 may be formed from patterned antenna traces 68 on flexible printed circuit 70. Metal can 72 may form a cavity such as cavity 88. Can 72 and cavity 88 may have an opening such as opening 100 that faces outwards in direction 102 towards antenna window 64.

Antenna can 72 may be coupled to ground using conductive material 98 (e.g., conductive adhesive, solder, a conductive gasket, or other conductive material). As shown in FIG. 10, peripheral ground traces 80 on flexible printed circuit 70 may include lower ground traces 80-1 on the lower surface of flexible printed circuit 70, upper ground traces 80-2 on the upper surface of flexible printed circuit 70, and vias 80-3 that short traces 80-1 and 80-2 together. Conductive material 78 such as solder or conductive adhesive may be used to short traces 80-1 to the exposed upper surface of lip 76 while attaching flexible printed circuit 70 in a bent configuration over opening 100. Conductive material 98 may couple ground traces 80 (e.g., upper ground trace 80-2) to the exposed inner surface of metal housing 12. Using this type of arrangement, can 72 may be sealed to housing 12, thereby isolating the antenna resonating element in antenna 32 from internal components in housing 12.

Figure 11:
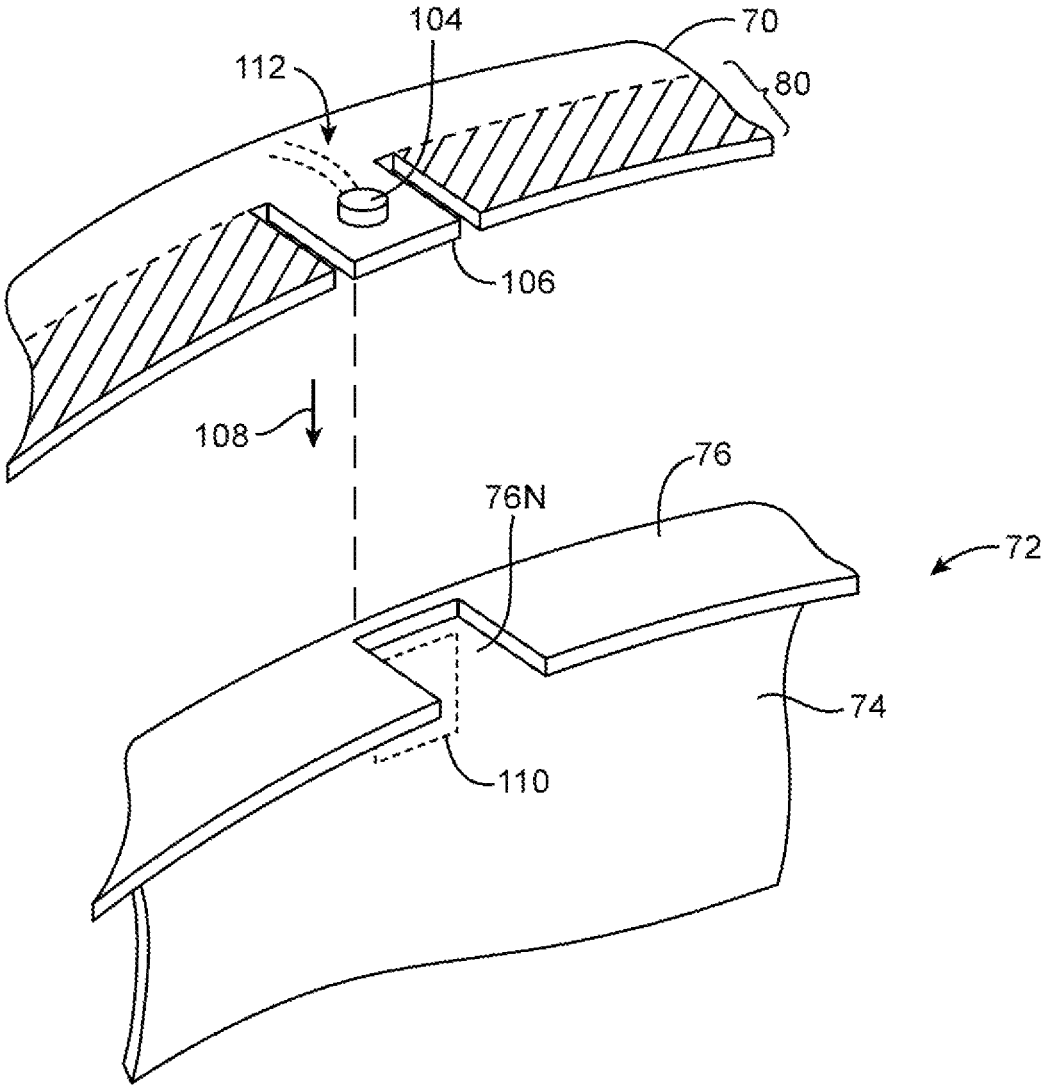
FIG. 11 is an exploded perspective view of an illustrative flexible printed circuit containing antenna traces and an associated metal antenna cavity structure with a notched lip in accordance with an embodiment of the present invention.

A connector such as a cable connector may be mounted to flexible printed circuit 70. As shown in FIG. 11, for example, cable connector 104 may be mounted to tab portion 106 of flexible printed circuit 70 along the edge of flexible printed circuit 70. Cable connector 104 may be a U.FL connector, an MHF connector, another miniature coaxial cable connector, or other connector. Conductive traces 112 on printed circuit 70 may form a transmission line that is used for coupling the positive and ground terminals of connector 104 to antenna terminals 36 and 38.

Flexible printed circuit 70 may be mounted to lip 76 of can 72 so that flexible printed circuit connector tab 106 and connector 104 are aligned with notch 76N in lip 76. Notch 76N may be formed from a rectangular opening or other gap in lip portion 76 of can 72 to accommodate bending of tab 106 downwards in direction 108. The underside of tab 106 may be provided with a rectangular metal trace that forms a ground pad. The ground pad may be soldered to portion 110 of wall 74 in can 72 after tab 106 has been bent downwards in direction 108. Tab 106 may have a rectangular shape, a semicircular shape, a triangular shape, or other suitable shape.

Figure 12:
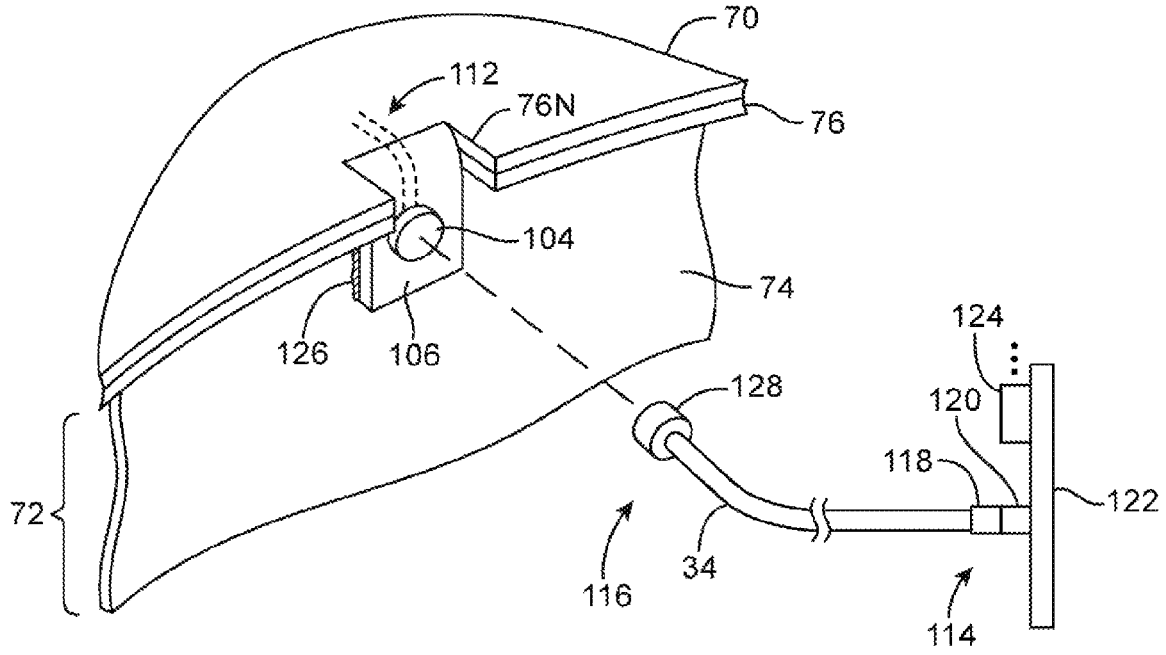
FIG. 12 is a perspective view of a flexible printed circuit and associated antenna cavity structure that have been assembled to form an antenna that can be coupled to radio-frequency transceiver circuitry using a transmission line such as a transmission line based on a cable in accordance with an embodiment of the present invention.

As shown in FIG. 12, tab 106 may have a right angle bend so that the plane of tab 106 lies perpendicular to the plane of flexible printed circuit 70. Solder 126 may couple tab 106 to metal can wall 74 (i.e., a metal solder pad on the underside of tab 106 may be soldered to wall 74 using solder 126). The configuration of FIG. 12 in which tab 106 is bent at a right angle to pass through notch 76N and lie on wall 74 of can 72 allows wall 74 to serve as a stiffener that supports flexible printed circuit tab 106 and cable connector 104. Tab 106 forms an integral portion of flexible printed circuit 70 and the antenna traces on flexible printed circuit 70, thereby avoiding the need to attach separate signal lines to antenna resonating element 54.

A transmission line path such as cable 34 may have a first end such as end 114 and an opposing second end such as end 116. Connector 118 at end 114 may be coupled to mating connector 120 on printed circuit board 122. Components 124 such as radio-frequency transceiver circuitry 44 and other integrated circuits and devices may be mounted on printed circuit board 122. Printed circuit board 122 may be a flexible printed circuit, a rigid printed circuit board, or other substrate for mounting electrical components. At end 116, cable 34 may have a connector such as connector 128. Connector 128 may mate with connector 104 on flexible printed circuit tab 106, thereby coupling radio-frequency transceiver circuitry 44 to antenna 32.

Figure 13:
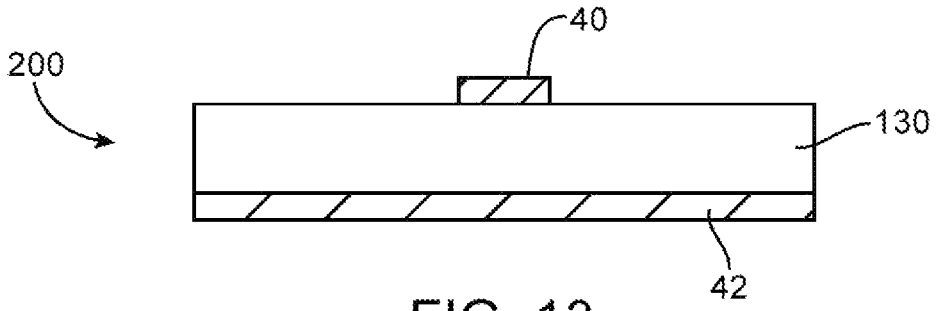
FIG. 13 is a cross-sectional side view of an illustrative microstrip transmission line that may be used in handling radio-frequency antenna signals in accordance with an embodiment of the present invention.

Transmission line structures such as transmission line 34 and transmission line 112 may be implemented using printed circuit transmission line structures, coaxial cable transmission line structures, or other types of transmission line structures. FIG. 13 is a cross-sectional side view of a microstrip transmission line structure of the type that may be used in forming some or all of transmission line path 34 of FIG. 6 and/or path 112 of FIG. 6. As shown in FIG. 13, path 200 (e.g., some or all of path 34 and/or path 112) may include dielectric substrate 130 (e.g., a printed circuit substrate such as a flexible printed circuit substrate), positive signal trace 40 and ground plane signal trace 42.

Figure 14:
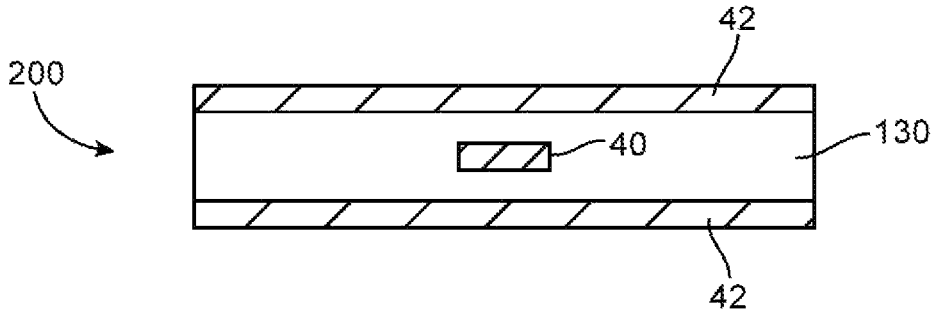
FIG. 14 is a cross-sectional side view of an illustrative stripline transmission line that may be used in handling radio-frequency antenna signals in accordance with an embodiment of the present invention.

FIG. 14 is a cross-sectional side view of a stripline transmission line. Transmission line 200 of FIG. 14 (e.g., some or all of path 34 and/or path 112) may have a dielectric substrate 130, positive signal line trace 40, and ground traces 42. Ground traces 42 may run above and below positive signal line 40.

Figure 15:
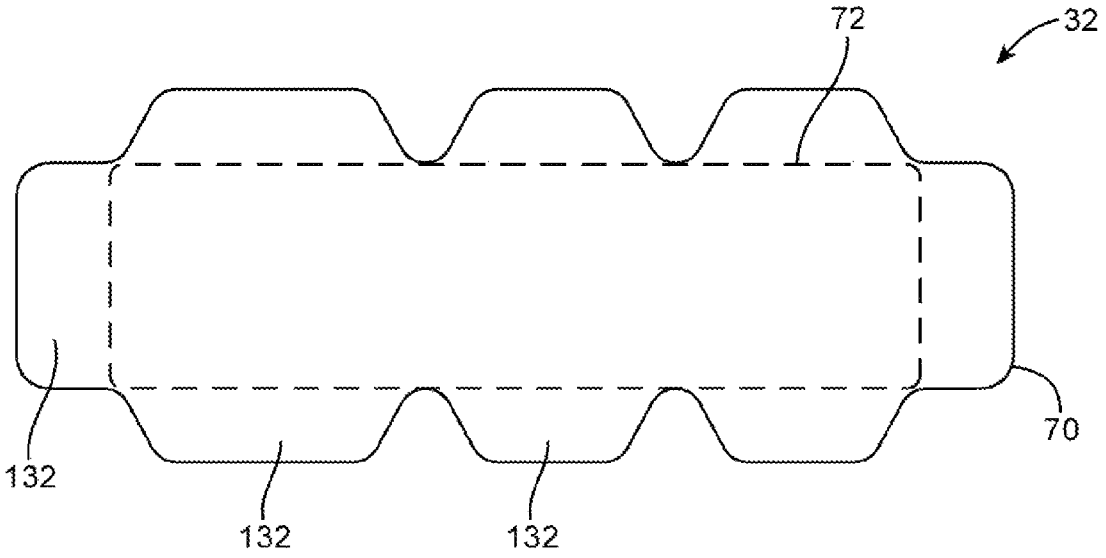
FIG. 15 is a top view of a flexible printed circuit in a flattened state showing how the flexible printed circuit may be provided with protruding tabs that can be bent downwards to couple the flexible printed circuit to a metal can that forms an antenna cavity in accordance with an embodiment of the present invention.

As shown in the top view of antenna structures 32 of FIG. 15, flexible printed circuit 70 may be provided with multiple tabs 132 around the periphery of metal can 72. Notches in lip 76, an inwardly-protruding lip shape, or other structures in antenna 32 can be used to allow tabs 132 to be bent downwards against the sides of metal can 72. Solder, conductive adhesive, or other attachment mechanisms may be used to electrically short and mechanically attach tabs 132 of flexible printed circuit 70 to the sides of can 72.

Figure 16:
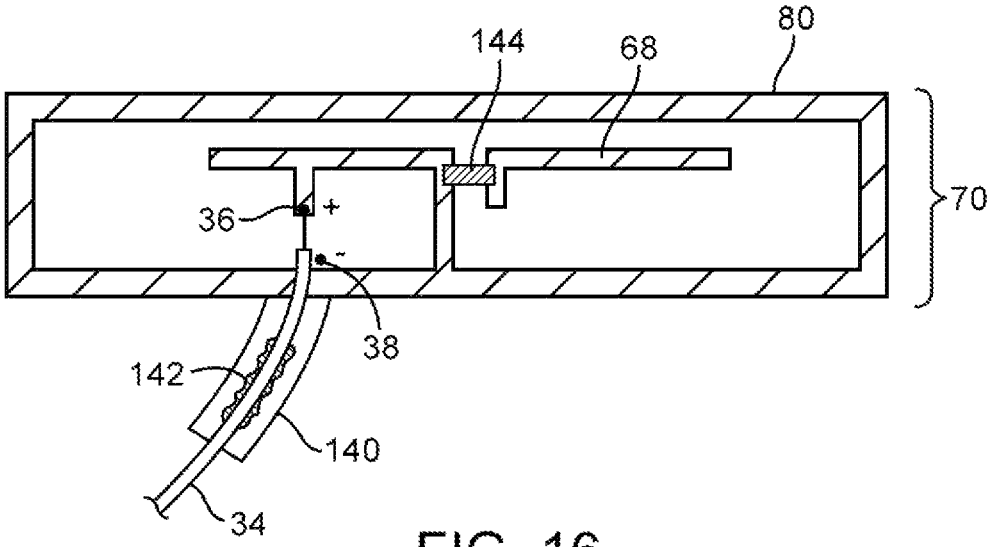
FIG. 16 is a top view of a flexible printed circuit for an antenna in which the flexible printed circuit has a tail portion for use in securing a transmission line such as a coaxial cable in accordance with an embodiment of the present invention.

FIG. 16 is a top view of antenna structures 32 in a configuration in which flexible printed circuit 70 has been provided with a protruding portion (e.g., a tab) such as tail 140. Tail 140 may be formed as an integral portion of flexible printed circuit 70. Coaxial cable 34 or other transmission line structures may be coupled to terminals 36 and 38 of antenna 32. Conductive material 142 (e.g., solder and/or conductive adhesive or other materials) may be used to attach cable 34 to tail 140. A solder pad structure may be formed on the upper surface of tail 140 to accept solder 142. An opposing solder pad on the lower surface of tail 140 may be used to facilitate soldering of tail 140 to can 72 and/or lip 74. Ground pads on the opposing upper and lower surfaces of tail 142 may be shorted to each other using vias. Vias may also be used when connecting different ground planes such as ground planes 42 of FIG. 14 or other flexible printed circuit structures. The presence of tail 140 may help relieve strain and thereby prevent cable 34 from becoming detached from traces 68 in flexible printed circuit 70. Solder may be used to couple a center conductor in cable 34 to terminal 36 and may be used to couple an outer conductor in cable 34 to terminal 38.

If desired, tunable components, filter components, matching network components, and other circuit components may be mounted on flexible printed circuit 70, as illustrated by component 144 of FIG. 16. Components such as component 144 may include adjustable capacitors, adjustable inductors, adjustable resistors, fixed capacitors, inductors, and resistors, switching circuitry, and other tunable circuits. Components such as component 144 may be packaged in surface mount technology packages or other packages that are soldered to metal traces on flexible printed circuit 70. There may be multiple components that are soldered to metal traces 68 on flexible printed circuit 70. The configuration of FIG. 16 in which a single component has been soldered to traces 68 is merely illustrative.

The flexible printed circuit on which antenna resonating element structures for antenna resonating element 54 are formed may be shared with other circuitry such as radio-frequency transceiver circuitry, switching circuitry, filter circuitry, sensor circuitry, impedance matching circuitry, and circuitry not directly associated with wireless operations (e.g., microphones, sensors, filters, etc.).

The use of flexible printed circuits in forming antenna structures 32 allows the antenna resonating element and ground plane structures to be flexed to accommodate a curved structure such as a curved antenna window. For slightly curved or planar windows, a thin rigid printed circuit board such as a fiberglass-filled epoxy board (e.g., an FR4 board) or other substrate may also be used.

If desired, portions of a printed circuit antenna structure such as tail 140 of FIG. 16 may be implemented using a printed circuit that has both a rigid portion (e.g., for the non-tail area) and a flexible portion (e.g., for tail 140). Printed circuits in which one or more flexible portions extend from a rigid portion are sometimes referred to as rigid flex boards, rigid flex substrates, or rigid flex. If desired, flexible printed circuit antennas 32 may be implemented using rigid flex substrates in which the flexible portion of the rigid flex substrate is bent as described in connection with flexible printed circuit 70 (i.e., flexible printed circuit 70 may be implemented using rigid flex). Printed circuit substrates (flexible printed circuits, rigid flex substrates, etc.)

may, if desired, be provided with stiffeners (e.g., a polyimide sheet, a stainless steel sheet, or other stiffening structures). Such stiffening structures may enhance mechanical support during soldering and assembly.

The foregoing is merely illustrative of the principles of this invention and various modifications can be made by those skilled in the art without departing from the scope and spirit of the invention.

What is claimed is:

1. A cavity antenna having an antenna resonating element and an antenna ground, comprising:

a flexible printed circuit having metal traces that form the antenna resonating element and having peripheral ground traces, wherein the antenna resonating element comprises an inverted-F antenna resonating element; and a metal can that forms the antenna ground and that forms a cavity with an opening, wherein the metal can has a lip that surrounds the opening and the flexible printed circuit is mounted over the opening so that the peripheral ground traces are coupled to the lip, and the lip comprises an outwardly bent portion of the metal can.

2. The cavity antenna defined in claim 1 wherein the lip has a notch.

3. The cavity antenna defined in claim 2 wherein the flexible printed circuit has a tab that passes through the notch.

4. The cavity antenna defined in claim 3 further comprising solder that solders the tab to the metal can.

5. The cavity antenna defined in claim 4 further comprising a cable connector on the tab.

6. The cavity antenna defined in claim 5 wherein the tab has a right angle bend.

7. The cavity antenna defined in claim 6 wherein the peripheral ground traces are soldered to the lip.

8. The cavity antenna defined in claim 7 wherein the flexible printed circuit is bowed and the lip has a curved shape that mates with the flexible printed circuit.

9. An electronic device, comprising:

a metal housing;

a curved antenna window in the metal housing; and an antenna formed from a metal can and metal traces on a flexible printed circuit, wherein the metal traces on the flexible printed circuit form an antenna resonating element for the antenna, the metal can defines a cavity with an opening and has a lip that surrounds the opening, the lip has a notch, the flexible printed circuit has a bent tab portion that passes through the notch, the flexible printed circuit is mounted to the lip and covers the opening, and the flexible printed circuit is bowed outwards to create a curved surface that matches the curved antenna window.

10. The electronic device defined in claim 9 wherein the lip is formed from bent portions of the metal can.

11. The electronic device defined in claim 10 wherein the flexible printed circuit contains peripheral ground traces that run along a peripheral edge of the flexible printed circuit and that are soldered to the lip.

12. The electronic device defined in claim 11 wherein the flexible printed circuit has an integral tail, the electronic device further comprising a cable coupled to the integral tail.

13. The electronic device defined in claim 10 further comprising a coaxial cable connector on the flexible printed circuit.

14. A cavity antenna having an antenna resonating element and an antenna ground, the cavity antenna comprising:

a metal can that forms the antenna ground, wherein the metal can has walls that surround a cavity with an opening, a lip that surrounds the opening, and a notch that is formed in the lip; and a flexible printed circuit having metal traces that form the antenna resonating element and having a tab with a bent tab portion, wherein the bent tab portion passes through the notch and is soldered to one of the walls.

15. The cavity antenna defined in claim 14 further comprising a cable connector on the tab.

16. The cavity antenna defined in claim 15 further comprising peripheral ground traces that run along a peripheral edge of the flexible printed circuit, the lip is formed from bent portions of the walls, and the peripheral ground traces are soldered to the lip.

17. The cavity antenna defined in claim 16 further comprising an electrical component that is soldered to the flexible printed circuit.

18. The cavity antenna defined in claim 14 wherein the metal can has four side walls and a rear wall, the opening opposes the rear wall, and the flexible printed circuit completely covers the opening.

* * * * *